US009225135B2

(12) United States Patent
Kondo

(10) Patent No.: US 9,225,135 B2
(45) Date of Patent: Dec. 29, 2015

(54) CONTACT IMPEDANCE ADJUSTING METHOD, CONTACT, AND CONNECTOR HAVING THE SAME

(71) Applicant: HOSIDEN CORPORATION, Yao-shi, Osaka (JP)

(72) Inventor: Hayato Kondo, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 148 days.

(21) Appl. No.: 13/742,684

(22) Filed: Jan. 16, 2013

(65) Prior Publication Data

US 2013/0196541 A1 Aug. 1, 2013

(30) Foreign Application Priority Data

Jan. 26, 2012 (JP) ..... 2012-014277

(51) Int. Cl.

| | |
|---|---|
| ***H01R 13/11*** | (2006.01) |
| ***H01R 43/16*** | (2006.01) |
| ***H01R 13/6474*** | (2011.01) |
| ***H01R 13/6473*** | (2011.01) |

(52) U.S. Cl.

CPC ..... *H01R 43/16* (2013.01); *H01R 13/112* (2013.01); *H01R 13/6473* (2013.01); *H01R 13/6474* (2013.01); *Y10T 29/49204* (2015.01)

(58) Field of Classification Search

USPC ..... 439/857, 941

IPC ..... H01R 13/111,13/112, 13/113, 13/6658, H01R 43/16, 23/005, 23/025; H05K 1/0228, H05K 2201/1018

See application file for complete search history.

(56) References Cited

U.S. PATENT DOCUMENTS

| | | | | |
|---|---|---|---|---|
| 6,164,995 | A * | 12/2000 | Peloza | 439/188 |
| 6,439,931 | B1 * | 8/2002 | Niitsu et al. | 439/660 |
| 2005/0112959 | A1 | 5/2005 | Lai | |
| 2008/0124974 | A1 * | 5/2008 | Barr et al. | 439/604 |
| 2010/0203768 | A1 | 8/2010 | Kondo | |
| 2011/0294349 | A1 * | 12/2011 | Kawakami et al. | 439/607.55 |
| 2013/0178115 | A1 * | 7/2013 | Ao et al. | 439/682 |

FOREIGN PATENT DOCUMENTS

| | | |
|---|---|---|
| EP | 2015402 | 1/2009 |
| EP | 2369685 | 9/2011 |
| JP | 07-211404 A | 8/1995 |
| JP | 2003-007402 | 1/2003 |
| JP | 2007-035587 | 2/2007 |
| JP | 2007-122900 A | 5/2007 |

(Continued)

OTHER PUBLICATIONS

Extended European Search Report mailed Apr. 19, 2013 in counterpart application No. 12250178.6 (7 pages).

(Continued)

*Primary Examiner* — Hien Vu

(74) *Attorney, Agent, or Firm* — Kratz, Quintos & Hanson, LLP

(57) ABSTRACT

The invention provides a method of adjusting an impedance of a contact including a first portion and a second portion having a higher impedance than the first portion. In this method, the second portion of the contact is provided with an impedance adjusting portion having electrically conductivity to increase a dimension in a thickness direction of the second portion.

16 Claims, 9 Drawing Sheets

(56) References Cited

FOREIGN PATENT DOCUMENTS

| | | | |
|---|---|---|---|
| JP | 2010-182623 | A1 | 8/2010 |
| JP | 2011-154894 | | 8/2011 |
| WO | 2012/008522 | | 1/2012 |

OTHER PUBLICATIONS

Notifications for Reasons for Refusal mailed on Apr. 28, 2015 for the counterpart Japanese application No. 2012-014277, with translation.

* cited by examiner

CONTACT IMPEDANCE ADJUSTING METHOD, CONTACT, AND CONNECTOR HAVING THE SAME

The present application claims priority under 35 U.S.C. §119 of Japanese Patent Application No. 2012-14277 filed on Jan. 26, 2012, the disclosure of which is expressly incorporated by reference herein in its entity.

BACKGROUND OF THE INVENTION

1. Technical Field

The invention relates to contact impedance adjusting methods, contacts, and connectors having the contacts.

2. Background Art

Japanese Unexamined Patent Publication No. 2010-182623 discloses a connector including an insulating body and first and second contacts arranged at different heights in the body. The first contacts each have a first portion and a second portion having a higher impedance than the first portion. The second contacts each have an adjusting portion, which is brought closer to the second portion when the first or second contact elastically deforms in a direction to be brought closer to each other. That is, the adjusting portion of each second contact comes closer to the second portion of the first contact, resulting in the second portion increases in capacitance and decreases in impedance. Consequently, the impedances are matched between the first portion of the first contact and the second portion of the first contact.

SUMMARY OF INVENTION

It should be noted that the above connector requires a second contact for the purpose of matching impedance between the first portion and the second portion of the first contact. For this reason, the number of components of the connector increases, possibly leading to increased costs. Moreover, it may also be difficult to miniaturize the connector with a larger number of components.

In view of the above circumstances, the invention provides a contact impedance adjusting method for adjusting the impedance of a contact without providing another component for impedance adjustment. The invention also provides such contact and a connector having the contact.

A contact impedance adjusting method in an aspect of the invention is a method of adjusting an impedance of a contact including a first portion and a second portion having a higher impedance than the first portion. In this method, the second portion of the contact is provided with an impedance adjusting portion having electrically conductivity to increase a dimension in a thickness direction of the second portion.

According to this aspect of the invention, by providing the second portion of the contact with the electrically conductive impedance adjusting portion, the second portion (including the impedance adjusting portion) increases in dimension in the thickness direction by the impedance adjusting portion and thereby increases in capacitance and decreases in impedance. As a result, it is possible to adjust the impedance of the second portion without using another component, and it is therefore possible to match the impedance between the first portion and the second portion.

In the case where the impedance adjusting portion is continuous with the second portion, the dimension in the thickness direction of the second portion may be increased by folding back the impedance adjusting portion in such a manner as to extend along the second portion. Alternatively, the dimension in the thickness direction of the second portion may be increased by bending the impedance adjusting portion in such a manner as to extend substantially perpendicular to the second portion.

According to these aspects of the invention, the second portion (including the impedance adjusting portion) can be increased in dimension in the thickness direction simply by folding back the impedance adjusting portion continuous with the second portion in such a manner as to extend along the second portion, or bending the impedance adjusting portion substantially perpendicular to the second portion. It is thus possible to adjust the impedance of the second portion easily.

Further alternatively, the dimension in the thickness direction of the second portion may be increased by disposing the impedance adjusting portion on the second portion.

According to this aspect of the invention, the second portion (including the impedance adjusting portion) can be increased in dimension in the thickness direction simply by disposing the impedance adjusting portion on the second portion. It is thus possible to adjust the impedance of the second portion easily.

A contact according to the invention includes a contact body and an impedance adjusting portion. The contact body includes a first portion and a second portion, and the second portion has a higher impedance than the first portion. The impedance adjusting portion has electrical conductivity and is provided at the second portion of the contact body to increase a dimension in a thickness direction of the second portion.

According to this aspect of the invention, the second portion of the contact body is provided with the electrically conductive impedance adjusting portion, resulting in that the second portion (including the impedance adjusting portion) increases in dimension in the thickness direction by the impedance adjusting portion and thereby increases in capacitance and decreases in impedance. As a result, it is possible to adjust the impedance of the second portion without using another component, and it is therefore possible to match the impedance between the first portion and the second portion.

The impedance adjusting portion may be continuous with the second portion and may be folded back to extend along the second portion. According to this aspect of the invention, the impedance adjusting portion continuous with the second portion of the contact is simply folded back along the second portion. It is thus possible to adjust the impedance of the second portion with a simple configuration.

Alternatively, the impedance adjusting portion continuous with the second portion may be bent to extend substantially orthogonal to the second portion. According to this aspect of the invention, the impedance adjusting portion continuous with the second portion of the contact is simply bent substantially perpendicular to the second portion. It is thus possible to adjust the impedance of the second portion with a simple configuration.

Further alternatively, the impedance adjusting portion may be disposed on the second portion. According to this aspect of the invention, the impedance adjusting portion is simply disposed on the second portion. It is thus possible to adjust the impedance of the second portion with a simple configuration.

The dimension in the thickness direction of the second portion may be smaller than a dimension in the thickness direction of the first portion. According to this aspect of the invention, the smaller dimension in the thickness direction of the second portion than that of the first portion causes a higher impedance of the second portion than the first portion.

The second portion may have a smaller cross-section than the first portion. According to this aspect of the invention, the smaller cross-section of the second portion than that of the first portion causes a higher impedance of the second portion than the first portion.

The second portion may include a bent portion and an adjacent portion. The adjacent portion may be located adjacent to the bent portion. The impedance adjusting portion may be continuous with at least one of the bent portion and the adjacent portion. According to this aspect of the invention, the existence of the bent portion in the second portion causes a higher impedance of the second portion than the first portion. However, there is provided with the impedance adjusting portion continuous with at least one of the bent portion and the adjusting portion of the second portion, and it is folded back to extend therealong or bent substantially perpendicular thereto. The impedance adjusting portion can thus decrease and adjust the impedance of the second portion.

Alternatively, the impedance adjusting portion may be disposed on at least one of the bent portion and the adjacent portion. According to this aspect of the invention, the existence of the bent portion in the second portion causes a higher impedance of the second portion than the first portion. However, there is provided with the impedance adjusting portion disposed on at least one of the bent portion and the adjusting portion of the second portion. The impedance adjusting portion can thus decrease and adjust the impedance of the second portion.

The first portion may be a portion of the contact body other than the second portion. Alternatively, the first portion may include a distal portion and an intermediate portion of the contact body. In this case, the distal portion may be a pair of contact portions, and the second portion may be a proximal portion of the contact body.

A connector according to the invention includes the contact according to any one of the above aspects, an insulative body holding the contact, and a tuboid shield case covering an outer periphery of the body.

DESCRIPTION OF EMBODIMENTS

A first preferred embodiment of the invention will be described with reference to FIG. 1A to FIG. 4B.

First Preferred Embodiment

Figure 1A:
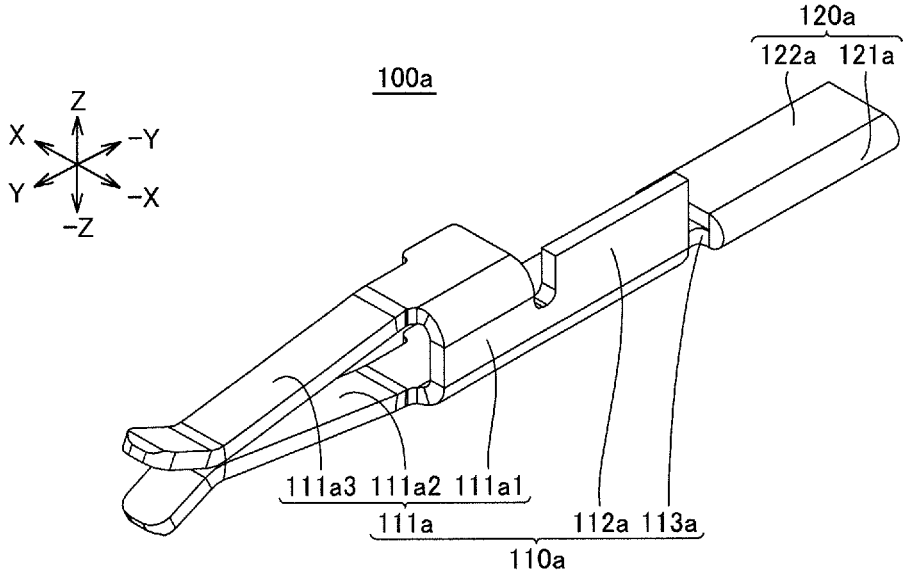
FIG. 1A is a schematic front, top, right perspective view of a first contact according to a first embodiment of the invention.
Figure 1B:
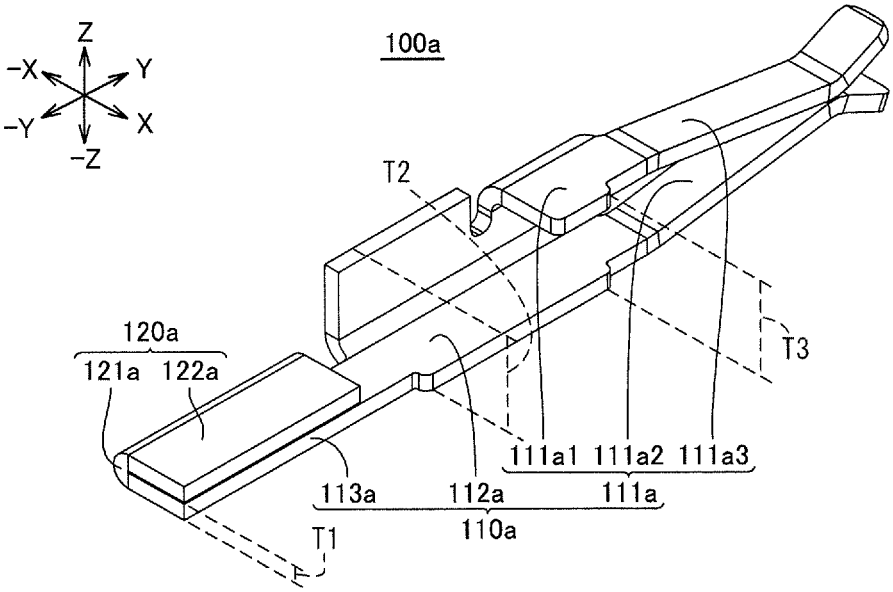
FIG. 1B is a schematic rear, top, left perspective view of the first contact.

First, a first contact 100*a* (corresponding to a contact in the claims) according to the first embodiment will be described with reference to FIG. 1A and FIG. 1B. In FIG. 1A and FIG. 1B, the arrows Y and −Y indicate the longitudinal directions of the first contact 100*a*, the arrows X and −X indicate the widthwise directions thereof, and the arrows Z and −Z indicate the thickness direction thereof. The X and −X directions are orthogonal to the Y and −Y directions, and the Z and −Z directions and the X and −X directions are orthogonal to the Y and −Y directions.

The first contact 100*a* is made of an electrically conductive metal plate. The first contact 100*a* includes a contact body 110*a* and an impedance adjusting portion 120*a*. The contact body 110*a* includes a distal portion 111*a*, an intermediate portion 112*a*, and a proximal portion 113*a*. The intermediate portion 112*a* is a generally L-shaped metal plate consisting of a horizontal plate and a vertical plate. The vertical plate is bent at a substantially right angle to the horizontal plate to extend in the Z direction.

The distal portion 111*a* includes a basal portion 111*a*1 and contact portions 111*a*2, 111*a*3. The basal portion 111*a*1 is a metal plate of generally horizontal U-shape, provided continuously with the Y direction end of the intermediate portion 112*a*. The basal portion 111*a*1 includes a vertical plate and first and second horizontal plates. The first horizontal plate is a metal plate continuous with the Y direction end of the horizontal plate of the intermediate portion 112*a*. The vertical plate of the basal portion 111*a*1 is a metal plate continuous with the −X direction end of the first horizontal plate and with the Y direction end of the vertical plate of the intermediate portion 112*a*. The vertical plate of the basal portion 111*a*1 is bent at a substantially right angle to the first horizontal plate to extend in the Z direction. The second horizontal plate is a metal plate continuous with the Z direction end of the vertical plate of the basal portion 111*a*1. The second horizontal plate is bent at a substantially right angle to the vertical plate of the basal portion 111*a*1 to extend in the X direction. The first and second horizontal plates are opposed to each other.

The contact portion 111*a*2 is a plate continuous with the Y direction end of the first horizontal plate to extend in the Y direction. The contact portion 111*a*3 is a plate continuous with the Y direction end of the second horizontal plate to extend in the Y direction. The contact portions 111*a*2, 111*a*3 are opposed to each other. The distal ends of the contact portions 111*a*2, 111*a*3 are bent so as to come closer to each other.

The proximal portion 113*a* is a metal plate that is continuous with the −Y direction end of the horizontal plate of the intermediate portion 112*a* to extend in the −Y direction. The proximal portion 113*a*, the horizontal plate of the intermediate portion 112*a*, and the first horizontal plate of the basal portion 111*a*1 form one metal plate, which has a first plane facing the Z direction and a second plane facing the −Z direction. FIG. 1B shows dimensions T1, T2, and T3, where T1 is the dimension in the Z and −Z directions (i.e. in a thickness direction) of the proximal portion 113*a*, T2 is the dimension in the Z and −Z directions (i.e. in the thickness direction) of the intermediate portion 112*a*, and T3 is the dimension in the Z and −Z directions (i.e. in the thickness direction) of the distal portion 111*a*. It is appreciated that dimension T1 is smaller than dimension T2 and than dimension T3. For this reason, the proximal portion 113*a* has a higher impedance than the distal portion 111*a* and the intermediate portion 112*a*. In the claims, the distal portion 111*a* and the intermediate portion 112*a* are referred to as a "first portion" of a contact, and the proximal portion 113*a* is referred to as a "second portion" of the contact. Also, the distal portion 111*a* and the intermediate portion 112*a* is a portion other than the proximal portion 113*a* of the contact body 110*a*.

The impedance adjusting portion 120*a* is an electrically conductive metal plate continuous with the −X direction end of the proximal portion 113*a*. The impedance adjusting portion 120*a* is folded back in the Z direction and then in the X direction so as to extend along the first plane of the proximal portion 113*a*. The impedance adjusting portion 120*a* includes a curved portion 121*a*, and an adjusting body 122*a*. The curved portion 121*a* is continuous with the −X direction end of the proximal portion 113*a* and is curved in the Z direction and then in the X direction to form a generally horizontal U-shape. The adjusting body 122*a* is a metal plate continuous with the curved portion 121*a*, and it is of nearly identical shape with the proximal portion 113*a*. The adjusting body 122*a* is disposed on the first plane of the proximal portion 113*a*, i.e. the adjusting body 122*a* is in face-to-face contact with the first plane of the proximal portion 113*a*.

Below is how the first contact 100*a* described above may be fabricated and how impedance matching may be achieved between the portions of the first contact 100*a*. First, an electrically conductive metal plate is prepared. The metal plate is press-molded in a press-molding machine to produce the first contact 100*a*. Specifically, the impedance adjusting portion 120*a* continuous with the −X direction end of the proximal portion 113*a* of the contact body 110*a* is folded back in the Z and X directions and thereby brought into contact with the first plane of the proximal portion 113*a*. As a result, the adjusting body 122*a* of the impedance adjusting portion 120*a* is disposed on the first plane of the proximal portion 113*a*, and the proximal portion 113*a* with the adjusting body 122*a* disposed thereon increases in Z and −Z direction dimension (i.e. the dimension in the thickness direction) by the adjusting body 122*a*. The proximal portion 113*a* with the adjusting body 122*a* disposed thereon thus increases in capacitance, thereby decreasing the impedance of the proximal portion 113*a*. This is how the impedance of the proximal portion 113*a* is adjusted such that impedance matching is established between the proximal portion 113*a* with the adjusting body 122*a* disposed thereon and the other portion than the proximal portion 113*a* of the contact body 110*a* (i.e. the distal portion 111*a* and the intermediate portion 112*a*).

A connector according to the first embodiment of the invention will be described below with reference to FIG. 2A to FIG. 4B. The connector shown in FIG. 2A to FIG. 3D is a plug connector for connection with a cable (not shown). The connector includes a plurality of the first contact 100*a* as described above, a plurality of second contacts 100*b*, a body 200, and a shield case 300. Each constituent of the connector will be described below in detail. The cable may include a plurality of signal wires and an outer insulator coating the signal wires. Each of the signal wires has a core wire and an inner insulator covering the core wire. FIG. 2A to FIG. 4B also indicates the Y and −Y directions, the X and −X directions, and the Z and −Z directions. The Y and −Y directions correspond to the lengthwise direction of the connector, the X and −X directions correspond to the widthwise direction of the connector, and the Z and −Z directions correspond to the height direction of the connector.

Figure 4A:
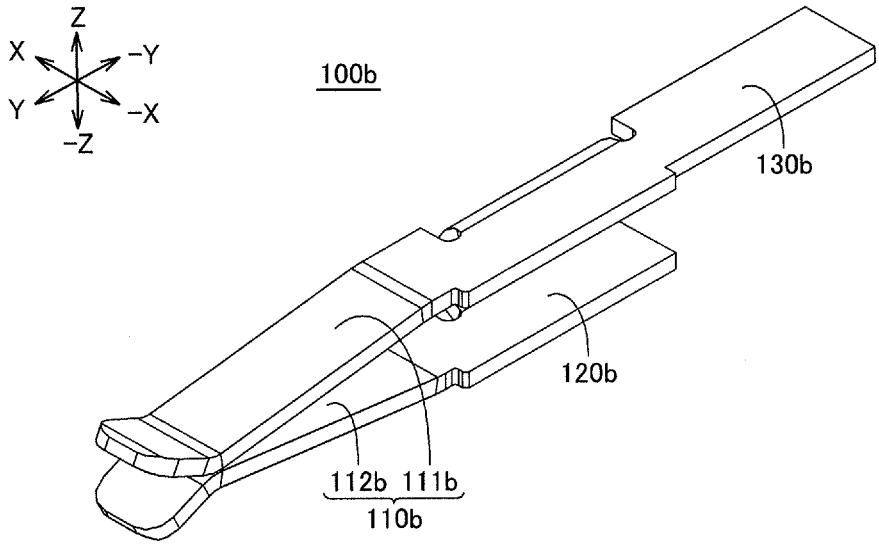
FIG. 4A is a schematic front, top, right perspective view of a second contact of the connector.
Figure 4B:
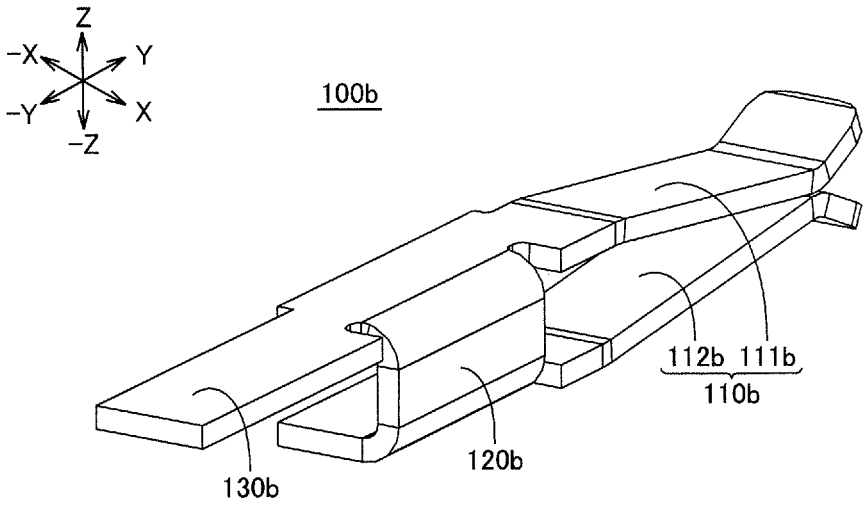
FIG. 4B is a schematic rear, top, left perspective view of the second contact of the connector.

Each of the second contacts 100*b*, as shown in FIG. 4A and FIG. 4B, is made of an electrically conductive metal plate. Each second contacts 100*b* includes a distal portion 110*b*, an intermediate portion 120*b*, and a proximal portion 130*b*. The intermediate portion 120*b* is a metal plate of horizontal U-shape. The intermediate portion 120*b* includes a vertical plate and first and second horizontal plates. The first horizontal plate of the intermediate portion 120*b* is a metal plate continuous with the Z direction end of the vertical plate and is bent at a substantially right angle to the vertical plate to extend in the −X direction. The second horizontal plate of the intermediate portion 120*b* is a metal plate continuous with the −Z direction end of the vertical plate and is bent at a right angle to the vertical plate to extend in the −X direction. The first and second horizontal plates are opposed to each other.

The distal portion 110*b* includes contact portions 111*b*, 112*b*. The contact portion 111*b* is a metal plate continuous with the Y direction end of the first horizontal plate of the intermediate portion 120*b* to extend in the Y direction. The contact portion 112*b* is a metal plate continuous with the Y direction end of the second horizontal plate of the intermediate portion 120*b* to extend in the Y direction. The contact portions 111*b*, 112*b* are opposed to each other. The distal ends of the contact portions 111*b*, 112*b* are bent so as to come closer to each other. The proximal portion 130*b* is a metal plate continuous with the −Y direction end of the first horizontal plate of the intermediate portion 120*b* to extend in the −Y direction.

As shown in FIG. 3A to FIG. 3D, the body 200 includes a first body 210 and a second body 220, which are made of insulating resin. The first body 210 is a generally rectangular block. The first body 210 includes a distal portion and a proximal portion that is connected to the distal portion and is smaller than the distal portion in the Z and −Z directions. The first body 210 has a plurality of first and second accommodating holes 211, 212 passing through the first body 210 in the Y and −Y directions. The first receiving holes 211 are spaced apart in the X and −X directions (refer to FIG. 2A and FIG. 2B). The second receiving holes 212 are spaced apart in the X and −X directions, at the same pitch as the first receiving holes 211, on the −Z side from the first receiving holes 211 (refer to FIG. 2A and FIG. 2B). The first receiving holes 211 receive the distal portions 111*a* and the intermediate portions 112*a* of the first contacts 100*a*, and the second receiving holes 212 receive the distal portions 110*b* and the intermediate portions 120*b* of the second contacts 100*b*. That is, the first and second contacts 100*a*, 100*b* are arranged at spacing in two rows in the X and −X directions inside the first body 210.

Figure 3A:
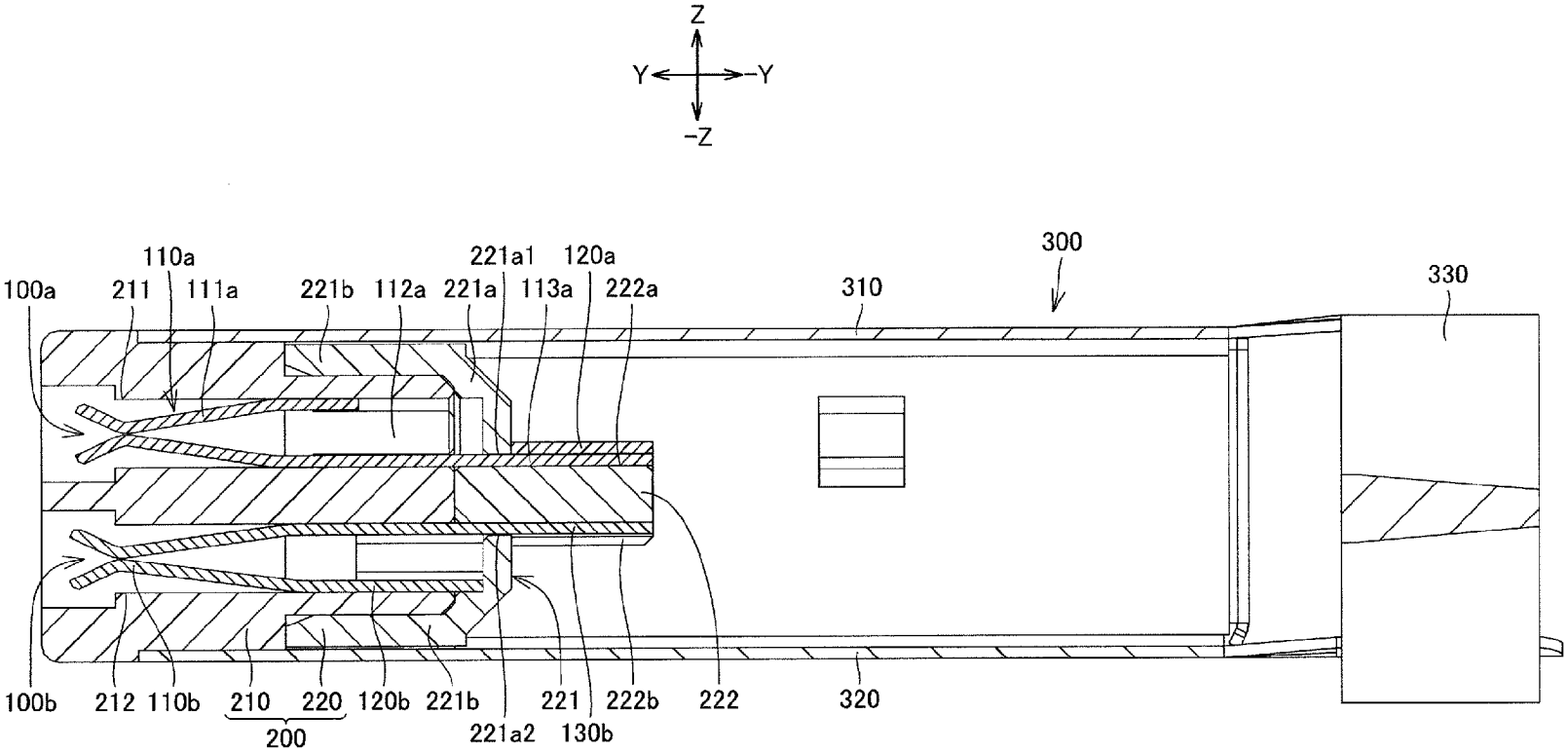
FIG. 3A is a schematic sectional view of the connector taken along the line 3A-3A in FIG. 2A.
Figure 3B:
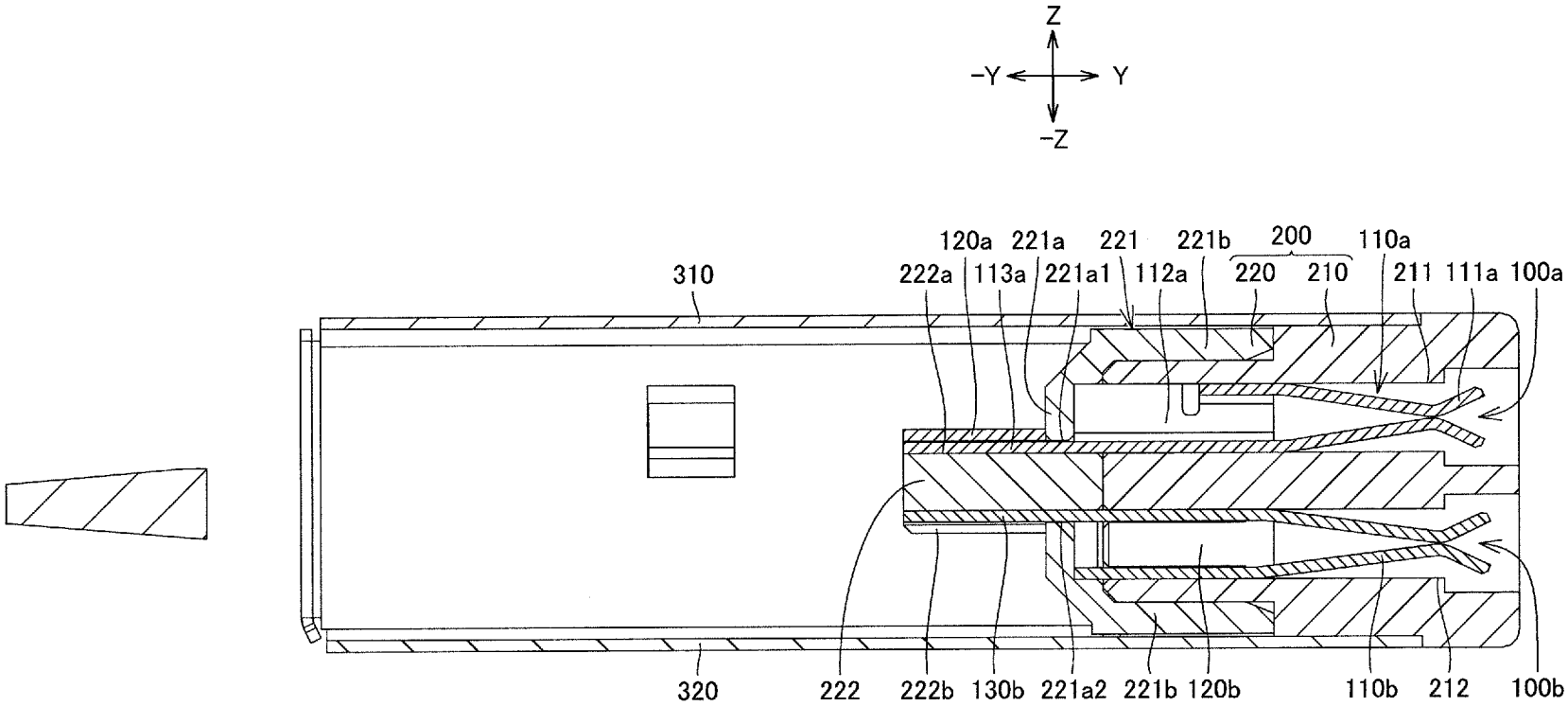
FIG. 3B is a schematic sectional view of the connector taken along the line 3B-3B in FIG. 2A.
Figure 3C:
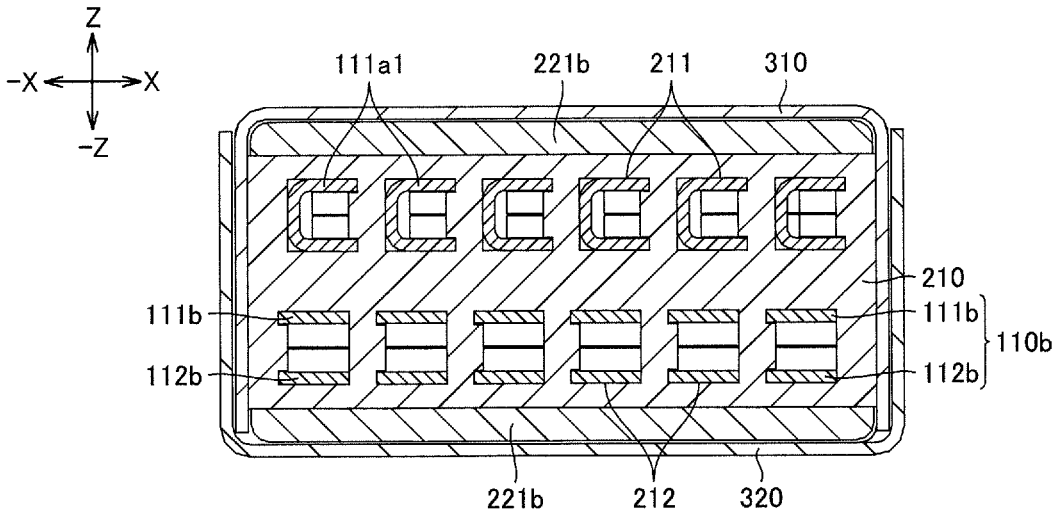
FIG. 3C is a schematic sectional view of the connector taken along the line 3C-3C in FIG. 2A.

The second body 220 includes a fitting portion 221 of generally horizontal U-shape and a tongue 222. The fitting portion 221 includes an intermediate portion 221*a*, and a pair of arms 221*b*. The arms 221*b* are continuous with the Z and −Z direction ends, respectively, of the intermediate portion 221*a* to extend in the Y direction. The distance in the Z and −Z directions between the arms 221*b* is substantially the same as the dimension in the Z and −Z directions of the proximal portion of the first body 210. The arms 221*b* are adapted to fittingly receive therebetween the proximal portion of the first body 210. The tongue 222 is provided at the center of the end face in the −Y direction of the intermediate portion 221*a*. The tongue 222 is a plate extending in the −Y direction. As shown in FIG. 3A to FIG. 3C, above the intermediate portion 221*a* of the tongue 222 extends a plurality of first through holes 221*a*1 at the same pitch as the first receiving holes 211. Likewise, below the intermediate portion 221*a* extends a plurality of second through holes 221*a*2 at the same pitch as the second receiving holes 212. The Z direction face of the tongue 222 is formed with a plurality of first grooves 222*a*, arranged at the same pitch as the first receiving holes 211. The −Z direction face of the tongue 222 is formed with a plurality of second grooves 222*b*, arranged at the same pitch as the second receiving holes 212. The first grooves 222*a* communicate with the respective first through holes 221*a*1, and the second grooves 222*b* communicate with the respective second through holes 221*a*2.

Figure 3D:
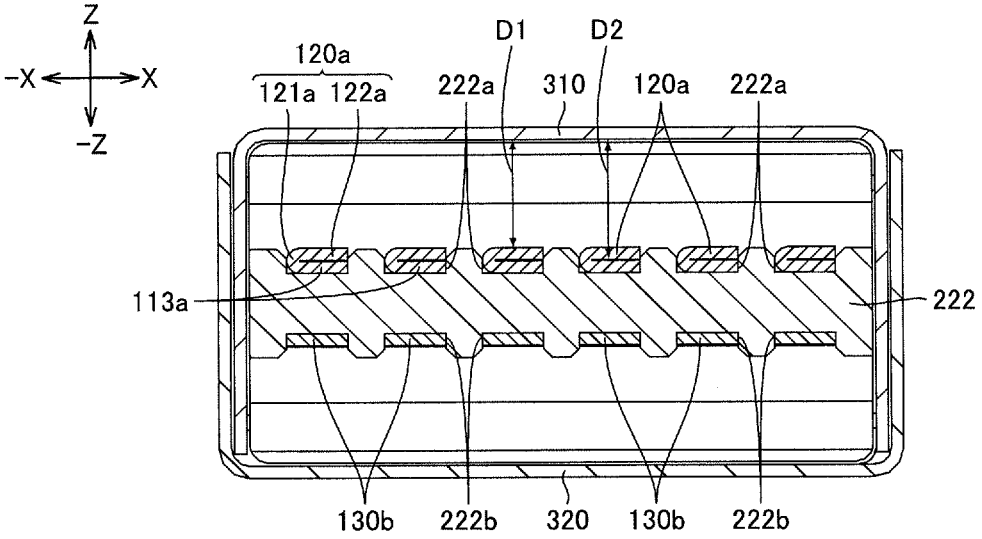
FIG. 3D is a schematic sectional view of the connector taken along the line 3D-3D in FIG. 2A.

As shown in FIG. 3A and FIG. 3B, the inner shape of each first through hole 221*a*1 conforms to the outer shape of the proximal portion 113*a* and the impedance adjusting portion 120*a* of each first contact 100*a*. As shown in FIG. 3A, FIG. 3B, and FIG. 3D, the width of each first groove 222*a* corresponds to the width of the proximal portion 113*a* and the impedance adjusting portion 120*a* of each first contact 100*a*. In other words, the first through holes 221*a*1 and the first grooves 222*a* are adapted to receive the proximal portions 113*a* and the impedance adjusting portions 120*a* of the first contacts 100*a*. The impedance adjusting portions 120*a* of the first contacts 100*a* as received in the first groove 222*a* are partly exposed, which exposed parts are used to connect some of the core wires of the signal lines of the cable.

As shown in FIG. 3A and FIG. 3B, the inner shape of each second through hole 221*a*2 conforms to the outer shape of the proximal portion 130*b* of each second contact 100*b*. As shown in FIG. 3A, FIG. 3B, and FIG. 3D, the width of each second groove 222*b* corresponds to the width of the proximal portion 130*b* of each second contact 100*b*. In other words, the second through holes 221*a*2 and the second grooves 222*b* are adapted to receive the proximal portions 130*b* of the second contacts 100*b*. The proximal portions 130*b* of the second contacts 100*b* as received in the second groove 222*b* are partly exposed, which exposed parts are used to connect the other core wires of the signal lines of the cable.

Figure 2A:
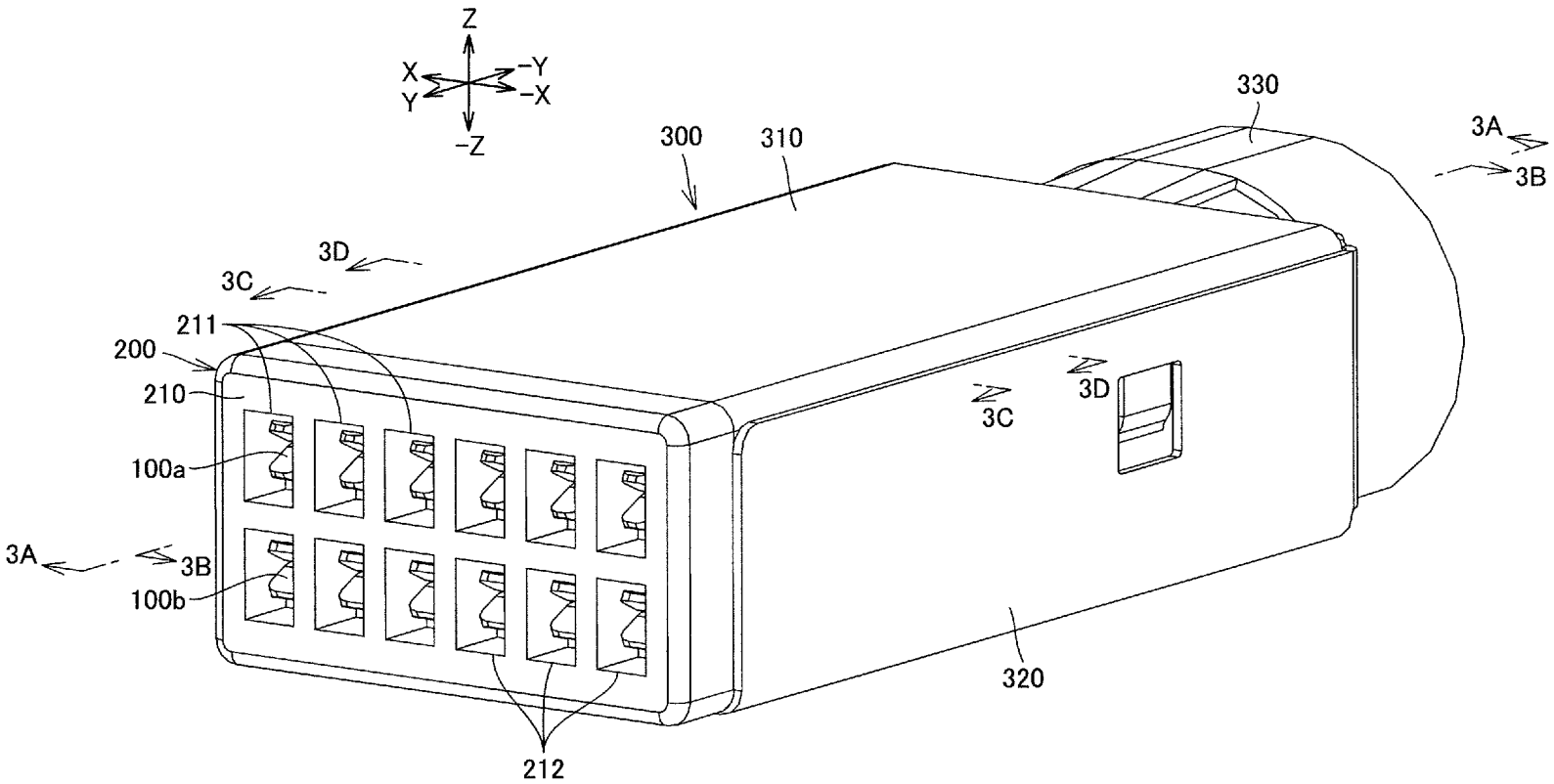
FIG. 2A is a schematic front, top, right perspective view of a connector according to the first embodiment of the invention.
Figure 2B:
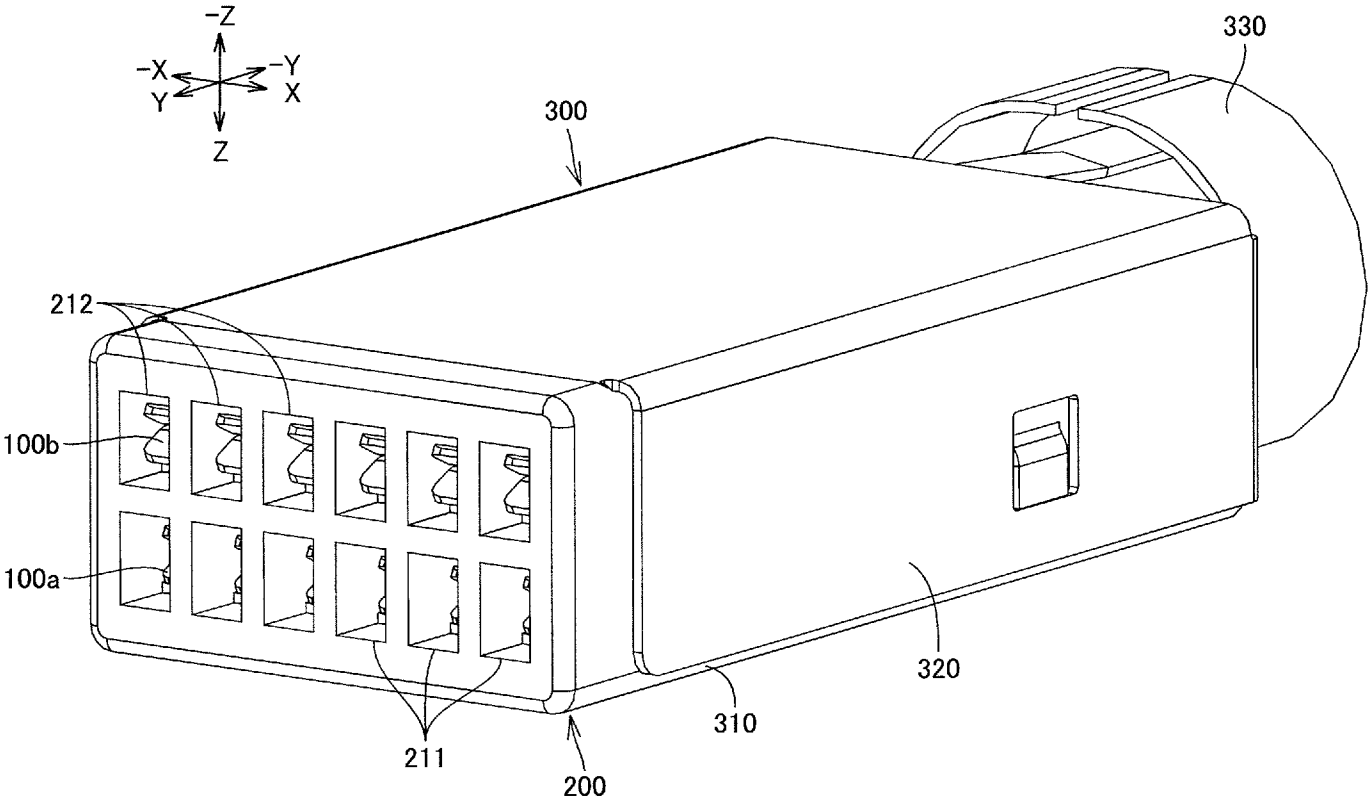
FIG. 2B is a schematic front, bottom, left perspective view of the connector.

As shown in FIG. 2A and FIG. 2B, the shield case 300 includes first and second shield cases 310, 320 and a cable holding portion 330. The first and second shield cases 310, 320 are each an electrically conductive metal plate of generally U-shape. The first and second shield cases 310, 320 are combined with each other to form a rectangular tuboid shape to cover the outer periphery of the body 200 as accommodating the first and second contacts 100*a*, 100*b*. The cable holding portion 330 is a ring-shaped plate connected to the −Y direction end of the first shield case 310. The cable is inserted from the cable holding portion 330 into the first and second shield cases 310, 320 to be connected to the first and second contacts 100*a*, 100*b*. The inserted cable is held by the cable holding portion 330.

The connector described above may be assembled and connected to a cable in the following steps. First, insulating resin is injection-molded in an injection molding machine to form the first body 210, and a metal plate is press-molded in a press-molding machine to form the first and second contacts 100*a*, 100*b*. Then, the distal portions 111*a* and the intermediate portions 112*a* of the first contacts 100*a* are inserted into the first receiving holes 211 of the first body 210. Similarly, the distal portions 110*b* and the intermediate portions 120*b* of the second contacts 100*b* are inserted into the second receiving holes 212 of the first body 210. The first and second contacts 100*a*, 100*b* are thus held in the first body 210. On the other hand, the second body 220 is also formed by injection-mold insulating resin in the injection molding machine. Thereafter, the proximal portions 113*a* and the impedance adjusting portions 120*a* of the first contacts 100*a* are inserted into the first through holes 221*a*1 and the first grooves 222*a* of the second body 220, and the proximal portions 130*b* of the second contacts 100*b* are inserted into the second through holes 221*a*2 and the second grooves 222*b* of the second body 220. Upon the insertion, the proximal portion of the first body 210 is fitted between the arms 221*b* of the second body 220. Consequently, the first and second bodies 210, 220 are combined with each other, and the first and second contacts 100*a*, 100*b* are held in two rows in the first and second bodies 210, 220 (in the body 200). Then, the cable is prepared. Thereafter, the core wires of the signal wires of the cable is soldered to the impedance adjusting portions 120*a* of the first contacts 100*a* and the proximal portions 130*b* of the second contacts 100*b*. Also prepared are the first shield case 310 and the cable holding portion 330, by press-molding a metal plates in a press-molding machine. The cable holding portion 330 at stage is not curved in the shape of a ring but is plate-like. Thereafter, the first shield case 310 is placed on the first and second bodies 210, 220 from the Z direction. The second shield case 320 is also prepared by press-molding a metal plate in the press-molding machine. The second shield case 320 is covered on the first and second bodies 210, 220 from the −Z direction. As a result, the first and second shield cases 310, 320 are combined with each other. Then, the cable holding portion 330 is curved in the shape of a ring to hold the cable.

The connector is connectable to a mating receptacle connector. When the connector is connected to the receptacle connector, contacts of the receptacle connector are received in the first and second storing holes 211, 212 of the first body 210. Specifically, the contacts in the upper row are received between and brought into contact with the contact portions 111*a*2, 111*a*3 of the distal portions 111*a* of the respective first contacts 100*a*, and the contacts in the lower row are received between and brought into contact with the contact portions 112*a*, 112*b* of the distal portions 110*b* of the respective second contacts 100*b*.

In the connector as described above, the proximal portion 113*a* of each first contact 100*a*, with the adjusting body 122*a* of the impedance adjusting portion 120*a* disposed thereon, is increased in dimension in the Z and −Z directions by the adjusting body 122*a* of the impedance adjusting portion 120*a*. Moreover, a distance D1 between the adjusting body 122*a* and a central plate of the first shield case 310 is smaller than a distance D2 between a proximal portion (with no impedance adjusting portion disposed thereon) and a central plate of a first shield case (refer to FIG. 3D). This configuration of the first contact 100*a* makes it possible to increase the capacitance of the proximal portion 113*a* with the adjusting body 122*a* disposed thereon and to reduce the impedance of the same, resulting in adjusted impedance of the proximal portion 113*a* of the contact body 110*a*. Consequently, it is possible to match impedance between the proximal portion 113*a* of the contact body 110*a* with the adjusting body 122*a* disposed thereon and the other portions than the proximal portion 113*a* of the contact body 110*a* (the distal portion 111*a* and the intermediate portion 112*a*). The first contact 100*a* is thus self-contained, i.e. does not require any additional component in adjusting the impedance of the proximal portion 113*a* of the contact body 110*a*, contributing to the reduction of the number of components of the connector and to the miniaturization of the connector. Further, the connector does not require such configuration as to elastically deform the second contact 100*b* to adjust the impedance of the proximal portion 113*a* of the contact body 110*a*. Therefore, the connector can be simplified in configuration.

The first contact and the connector of the invention are not limited to the configurations of the above embodiment, and they may be appropriately modified in design within the scope of claims. The modification examples will be described below in detail.

In the first contact 100*a* of the above embodiment, the first portion of the contact body 110*a* is the distal portion 111*a* and the intermediate portion 112*a*, and the second portion of the contact body 110*a* is the proximal portion 113*a*. However, the first portion of the contact body may be any portion of the contact body. The second portion of the contact body may be any portion of the contact body that has a higher impedance than the first portion of the contact body. The first and second portions may be of shape as in the above embodiment or may be of any other shape. In the above embodiment, the first portion of the contact body is the other portion than the second portion (the proximal portion 113*a*) of the contact body. However, the first portion of the contact body may be a part of the other portion than the second portion of the contact body.

Figure 5A:
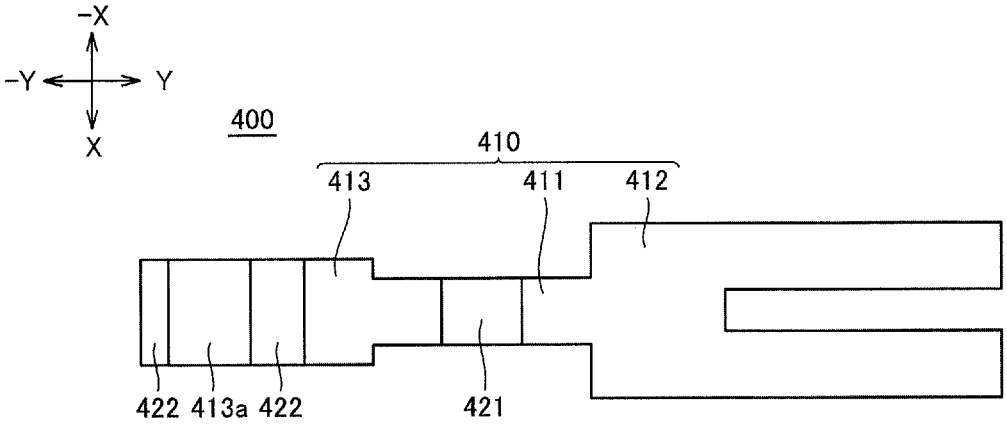
FIG. 5A is a schematic plan view showing a modification example of the first contact.
Figure 5B:
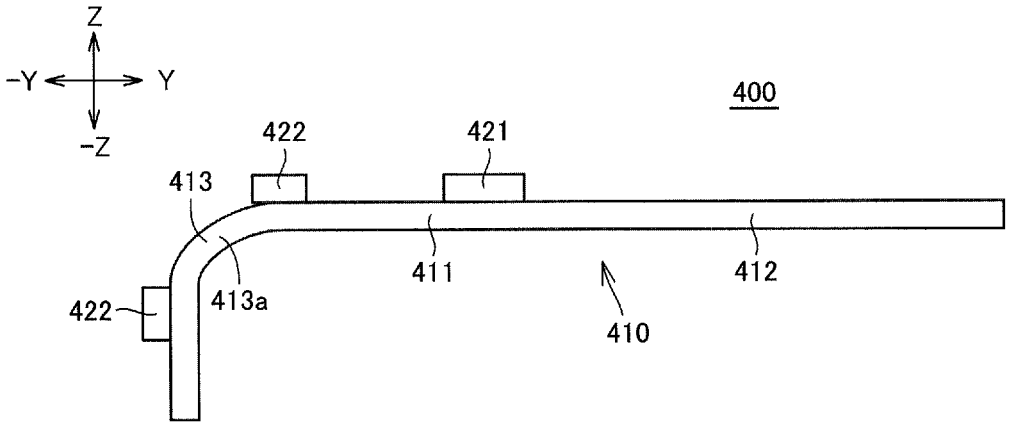
FIG. 5B is a schematic side view of the modified first contact.

In the above embodiment, the second portion of the contact body has a higher impedance than the first portion of the contact body because the second portion of the contact body is smaller than the first portion of the contact body in dimension in the Z and −Z directions (i.e. dimension in the thickness direction). However, an impedance mismatch may occur between the first portion and the second portion of the contact body due to other reasons. For example, FIG. 5A and FIG. 5B illustrate a modified first contact 400, wherein a second portion 411 (an intermediate portion) of a contact body 410 has a smaller cross-section in the widthwise direction (X and −X directions) than a first portion 412 (a distal portion) of the contact body, and another second portion 413 (a proximal portion) of the contact body 410 includes a bent portion 413*a*. Such configurations should cause a higher impedance of the second portions 411, 413 of the contact body 410 than the first portion 412. This impedance mismatch is resolved by providing an impedance adjusting portion 421 and impedance adjusting portions 422 as shown. More particularly, the impedance adjusting portion 421 is an electrically conductive metal plate continuous with the −X direction end of the second portion 411 and is folded back in the Z and X directions so as to be disposed on the second portion 411. The impedance adjusting portions 422 are each an electrically conductive metal plate continuous with the −X direction end of each adjacent portion on either side of the bent portion 413*a* of the second body 413. One of the impedance adjusting portions 422 is folded back in the Z and X directions so as to be disposed on the adjacent portion on the Y direction end side of the bent portion 413*a*. The other impedance adjusting portion 422 is folded back in the −Y and X directions so as to be disposed on the other adjacent portion on the −Y direction end side of the bent portion 413*a*.

Figure 7:
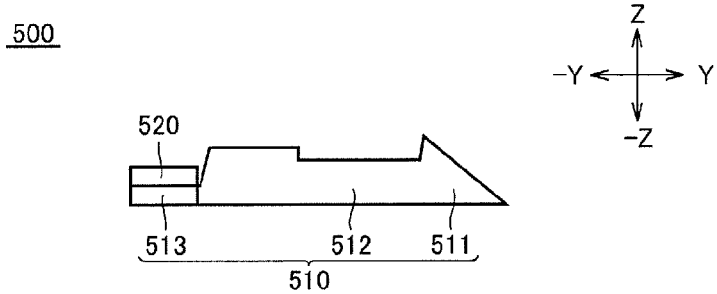
FIG. 7 is a schematic sectional view showing another modification example of the first contact.

FIG. 7 illustrates another modified first contact 500, wherein first portions 511, 512 of a contact body 510 has a smaller cross-section in the Z and −Z directions than a second portion 513. Such configurations should cause a higher impedance of the second portion 513 of the contact body 510 than the first portions 512, 512. The first portion 511 is a distal portion of the contact body 510, the first portion 512 is an intermediate portion of the contact body 510, and the second portion 513 is a proximal portion of the contact body 510. The impedance mismatch is resolved by providing an impedance adjusting portion 520. The impedance adjusting portion 520 is an electrically conductive metal plate continuous with the Z direction end of the second portion 513 and disposed on the second portion 513.

A higher impedance of the second portion of the contact body than the first portion of the contact body may occur due to the first contact itself as described above or due to external factors such as positional relationship between the first contact and other contacts, positional relationship between the first contact and the shield case.

Figure 6A:
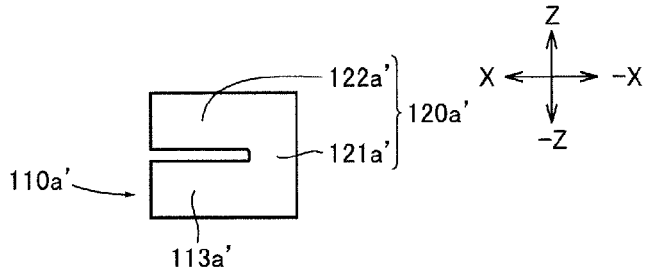
FIG. 6A is a schematic sectional view showing a first modification example of a second portion and an impedance adjusting portion of the first contact.
Figure 6B:
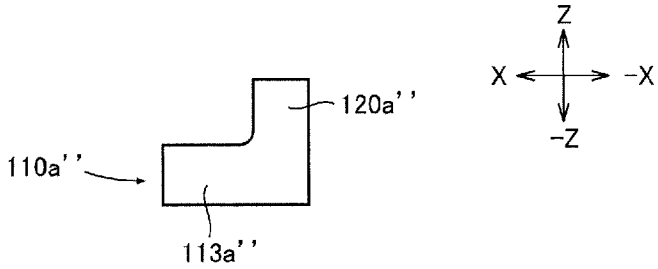
FIG. 6B is a schematic sectional view showing a second modification example of the second portion and the impedance adjusting portion of the first contact.

The impedance adjusting portion in the above embodiment is an electrically conductive metal plate continuous with the −X direction end of the second portion of the contact body and is folded back in the Z and X directions so as to be disposed on the first plane of the second portion. However, the impedance adjusting portion of the invention may be modified in design as long as it is electrically conductive, provided in the second portion of the contact body, and adapted to increase the dimension in the thickness direction of the second portion. FIG. 6A illustrates a modified first contact including an impedance adjusting portion 120*a*'. The impedance adjusting portion 120*a*' is an electrically conductive metal plate continuous with the −X direction end of a second portion 113*a*' of a contact body 110*a*' and is folded back in the Z and X directions so as to extend along a first plane of the second portion 113*a*'. In this case, there is a gap between an adjusting body 122*a*' of the impedance adjusting portion 120*a*' and the second portion 113*a*'. A reference numeral 121*a*' in FIG. 6A denotes a curved portion of the impedance adjusting portion. FIG. 6B illustrates another modified first contact including an impedance adjusting portion 120*a*". The impedance adjusting portion 120*a*" is an electrically conductive metal plate continuous with the −X direction end of a second portion 113*a*" of a contact body 110*a*" and is bent substantially perpendicular to the second portion 113*a*". Further alternatively, the impedance adjusting portion may be continuous with a portion other than the −X direction end of the second portion of the contact body (e.g. the X direction end, the −Y direction end, the Z direction end, or the −Z direction end).

Figure 6C:
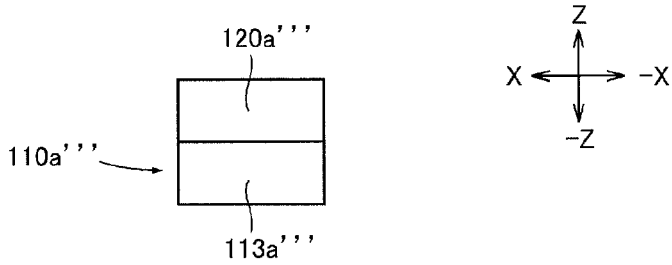
FIG. 6C is a schematic sectional view showing a third modification example of the second portion and the impedance adjusting portion of the first contact.

FIG. 6C illustrates still another modified first contact including an impedance adjusting portion 120*a*'''. The impedance adjusting portion 120*a*''' is an electrically conductive metal plate provided separately from a contact body 110*a*''' and disposed on a second portion 113*a*''' of the contact body 110*a*'''. In any of the modified contacts as described above, the second portion of the contact body is provided with an impedance adjusting portion, increasing the dimension in the Z and −Z directions (the dimension in the thickness direction) of the second portion including the impedance adjusting portion, and thereby adjusting the impedance between the first portion of the contact body and the second portion of the contact body including the impedance adjusting portion. The modified impedance adjusting portions 421, 422, 520 may be further modified as shown in FIG. 6A to FIG. 6C. Further, the modified first contact 400 may be further modified with respect to the impedance adjusting portion 422 continuous with the −X direction end of the second portion 413. Particularly, the impedance adjusting portion 422 may be folded back to extend along the second portion 413 or may extend perpendicularly to the second portion 413. Alternatively, the impedance adjusting portion 422 may be provided as a separate component to be disposed on the second portion 413.

The adjusting body 122*a* of the above embodiment is a metal plate having a generally same shape as the second portion 113*a* of the contact body 110*a*. However, the outer dimensions of the adjusting body of the invention may be smaller or larger than the outer dimensions of the second portion of the contact body. In other words, the adjusting body may of any outer dimensions if determined based on a difference in impedance between the first portion and the second portion of the contact body.

In the above embodiment, the method of adjusting the impedance of the first contact 100*a* is such that a metal plate is press-molded to form the first contact 100*a* with an impedance adjusting portion 120*a* continuous with the −X direction ends of the second portion 113*a* of the contact body 110*a*, the impedance adjusting portion 120*a* being folded back in the Z and X directions to be brought into contact with the first plane of the second portion 113*a*. However, the impedance adjusting method of the invention may be any method of adjusting an impedance of a contact, the contact including a first portion and a second portion having a higher impedance than the first portion, the method including the provision of the second portion of the contact with an impedance adjusting portion having electrical conductivity to increase the dimension in the thickness direction of the second portion. An example of such method is, as described above, to provide an electrically conductive impedance adjusting portion continuous with the −X direction end of the second portion of the contact body and to fold back the impedance adjusting portion in the Z and X directions so as to extend along the first plane of the second portion when press-molding the contact, thereby increasing the dimension in the Z and −Z direction (the dimension in the thickness direction) of the second portion including the impedance adjusting portion. In this case, there may be a gap formed between the adjusting body of the impedance adjusting portion and the second portion. An alternative method is to provide an electrically conductive impedance adjusting portion continuous with the −X direction end of the second portion of the contact body and to bend the impedance adjusting portion substantially perpendicular to the second portion when press-molding the contact, thereby increasing the dimension in the Z and −Z direction (the dimension in the thickness direction) of the second portion including the impedance adjusting portion. Another alternative method is to provide an electrically conductive impedance adjusting portion separately from the contact body to dispose the impedance adjusting portion on the second portion of the contact body, thereby increasing the dimension in the Z and −Z direction (the dimension in the thickness direction) of the second portion including the impedance adjusting portion.

It may not be at the time of press-molding the contact when the electrically conductive impedance adjusting portion continuous with the −X direction end of the second portion of the contact body are folded back along the first plane of the second portion or bent substantially perpendicular to the second portion. For example, after casting electrically conductive metal to form the contact body including the first and second portions and the impedance adjusting portion continuous with the −X direction end of the second portion of the contact body, the impedance adjusting portion may be folded back along the first plane of the second portion or bent relative to the second portion substantially perpendicularly. Alternatively, the impedance adjusting portion may be disposed on the second portion after casting the contact body including the first and second portions.

The connector of the above embodiment includes the first and second contacts 100*a*, 100*b*, the body 200, and the shield case 300. However, the connector of the invention may be modified in any manner as long as the connector includes a contact having a first portion, a second portion, and an impedance adjusting portion as described above; an insulating body adapted to hold the contact; and a tuboid shield case adapted to cover the outer periphery of the body. The contact may be insert-molded in the body. The second contact may be omitted.

It should be noted that the materials, the shapes, the dimensions, the numbers, and the arrangements of the components of the first contact and the connector according to in the above embodiment and modifications are described by way of example only and may be appropriately modified as long as similar functions can be achieved. The connector of the invention may be a plug connector as described above or it may be a receptacle connector. If used as a receptacle connector, a part of the first contact may be used for connection to a circuit board.

REFERENCE SIGNS LIST

100*a* first contact
110*a* contact body
111*a* distal portion (first portion of contact body)
112*a* intermediate portion (first portion of contact body)
113*a* proximal portion (second portion of contact body)
120*a* impedance adjusting portion
100*b* second contact
110*b* distal end
120*b* intermediate portion
130*b* proximal portion
200 body
210 first body
211 first receiving hole
212 second receiving hole
220 second body
221 engaging portion
221*a* intermediate portion
221*a*1 first through hole
221*a*2 second through hole
221*b* beam
222 tongue
222*a* first groove
222*b* second groove
300 shield case
310 first shield case
320 second shield case
330 cable holding portion

The invention claimed is:

1. A method of adjusting an impedance of a contact, the contact including a first portion and a second portion having a higher impedance than the first portion, the method comprising:

providing the second portion of the contact with an impedance adjusting portion having electrical conductivity to increase a dimension in a thickness direction of the second portion by folding back the impedance adjusting portion in such a manner as to extend along the second portion and decrease the impedance of the second portion such that impedances of the first portion and the second portion are matched.

2. The method according to claim 1, wherein the impedance adjusting portion is continuous with the second portion.

3. The method according to claim 1, wherein the impedance adjusting portion is continuous with the second portion, and the dimension in the thickness direction of the second portion is increased by bending the impedance adjusting portion in such a manner as to extend substantially perpendicular to the second portion.

4. The method according to claim 1, wherein the dimension in the thickness direction of the second portion is increased by disposing the impedance adjusting portion on the second portion.

5. The contact according to claim 1, wherein the contact generally extends in a first direction, the impedance adjusting portion is contiguous with an end in a second direction of the second portion, the second direction being perpendicular to the first direction, the thickness direction is perpendicular to the first and second directions.

6. A contact comprising:

a contact body including a first portion and a second portion, the second portion having a higher impedance than the first portion; and an impedance adjusting portion having electrical conductivity and being contiguous with the second portion of the contact body, the impedance adjusting portion including an adjusting body, wherein the impedance adjusting portion is folded back such that the adjusting body is in parallel with the second portion, and wherein the first portion is a portion of the contact body excluding the second portion.

7. The contact according to claim 6, wherein:

the contact generally extends in a first direction, the impedance adjusting portion is contiguous with an end in a second direction of the second portion, the second direction being perpendicular to the first direction, the second portion is smaller in dimension in a thickness direction than the first portion, the thickness direction being perpendicular to the first and second directions.

8. The contact according to claim 6, wherein the second portion has a smaller cross-section than the first portion.

9. The contact according to claim 6, wherein the second portion includes a bent portion and an adjacent portion, the adjacent portion being located adjacent to the bent portion, and the impedance adjusting portion is continuous with at least one of the bent portion and the adjacent portion.

10. The contact according to claim 6, wherein the first portion comprises a distal portion and an intermediate portion of the contact body, the distal portion including a pair of contact portions, and the second portion comprises a proximal portion of the contact body.

11. A connector comprising:

the contact according to claim 6;

an insulative body holding the contact; and a tuboid shield case covering an outer periphery of the body.

12. The contact according to claim 6, wherein the adjusting body is in face-to-face contact with the second portion.

13. The contact according to claim 6, wherein the adjusting body is in parallel with the second portion with a gap therebetween.

14. A method of adjusting an impedance of a contact, the contact including:

a first portion, a second portion having a higher impedance than the first portion, and an impedance adjusting portion having electrical conductivity and being continuous with the second portion, the impedance adjusting portion including an adjusting body, the method comprising folding back the impedance adjusting portion such that the adjusting body is in parallel with the second portion, wherein the first portion is a portion of the contact body excluding the second portion.

15. The method according to claim 14, wherein the folding back of the impedance adjusting portion includes folding back the impedance adjusting portion such that the adjusting body is in face-to-face contact with and in parallel with the second portion.

16. The method according to claim 14, wherein the folding back of the impedance adjusting portion includes folding back the impedance adjusting portion such that the adjusting body is in parallel with the second portion with a gap therebetween.

* * * * *